US008726415B2

(12) United States Patent
Grilliot et al.

(10) Patent No.: US 8,726,415 B2
(45) Date of Patent: May 20, 2014

(54) PROTECTIVE GARMENTS HAVING ELASTOMERIC GASKETS ALONG MARGINS TO INHIBIT INGRESS OF POTENTIALLY HARMFUL MATERIALS

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 1259 days.

(21) Appl. No.: 10/999,437

(22) Filed: Nov. 30, 2004

(65) Prior Publication Data

US 2009/0320191 A1 Dec. 31, 2009

(51) Int. Cl.
*A62B 17/00* (2006.01)
*A41D 27/02* (2006.01)

(52) U.S. Cl.
USPC ..... 2/81; 2/97

(58) Field of Classification Search
USPC ..... 2/456–458, 2.15, 81, 85, 92, 93, 123, 2/125, 232, 270, 604, 242, 241, 82, 87, 2/97, DIG. 5, 59, 162
See application file for complete search history.

(56) References Cited

U.S. PATENT DOCUMENTS

| | | | | | |
|---|---|---|---|---|---|
| 507,466 | A | * | 10/1893 | Van Oostrum | 2/82 |
| 931,711 | A | * | 8/1909 | Hochstuhl | 2/270 |
| 954,311 | A | * | 4/1910 | Leiner | 2/270 |
| 1,143,282 | A | * | 6/1915 | King | 2/83 |
| 1,237,180 | A | * | 8/1917 | Diddle | 2/162 |
| 1,642,670 | A | * | 9/1927 | Davis et al. | 2/82 |
| 1,652,750 | A | * | 12/1927 | Wohlgemuth | 2/227 |
| 1,773,456 | A | * | 8/1930 | Good | 2/85 |
| 1,784,285 | A | * | 12/1930 | Heaton | 2/270 |
| 2,123,969 | A | * | 7/1938 | Rosenblatt | 2/93 |
| 2,274,270 | A | * | 2/1942 | Kalb | 2/227 |
| 2,316,033 | A | * | 4/1943 | Walsh | 2/162 |
| 2,655,663 | A | * | 10/1953 | Hoagland | 2/270 |
| 2,670,471 | A | * | 3/1954 | Kaufman | 2/80 |
| 2,686,916 | A | * | 8/1954 | De Grazia | 2/162 |
| 2,813,272 | A | * | 11/1957 | Hagan | 285/260 |
| 2,994,089 | A | * | 8/1961 | Ferguson, Jr. et al. | 2/81 |
| 3,028,576 | A | * | 4/1962 | Gerard | 156/251 |
| 3,178,725 | A | * | 4/1965 | Ross | 2/167 |
| 3,191,187 | A | * | 6/1965 | Comer et al. | 2/167 |
| 3,231,899 | A | * | 2/1966 | Seidel et al. | 2/93 |
| 3,389,407 | A | * | 6/1968 | Morrison | 2/84 |

(Continued)

FOREIGN PATENT DOCUMENTS

EP 0 701 782 3/1996

*Primary Examiner* — Alissa L Hoey
(74) *Attorney, Agent, or Firm* — Wood, Phillips, Katz, Clark & Mortimer

(57) ABSTRACT

In an ensemble for a firefighter or for an emergency rescue worker, protective trousers and a protective coat are provided with elastomeric gaskets, such as neoprene gaskets, one of which lines an inside surface of a distal margin of each leg of the protective trousers and is adapted to be snugly stretched around a protective boot, another of which lines an inside surface of a distal margin of each arm of the protective coat and is adapted to be snugly stretched around a protective glove, and another of which lines an inside surface of a lower margin of the protective coat and is adapted to be snugly stretched around the protective trousers. Such gaskets extend from and, preferably, are unitary with liners, such as neoprene liners, which provide moisture and/or chemical barriers. When stretched snugly, such gaskets inhibit ingress of potentially harmful materials, whether gaseous, liquid, or particulate.

15 Claims, 1 Drawing Sheet

(56) References Cited

U.S. PATENT DOCUMENTS

| | | | | | |
|---|---|---|---|---|---|
| 3,496,572 | A | * | 2/1970 | Herzig | 2/457 |
| 3,671,975 | A | * | 6/1972 | Vorsteher | 2/232 |
| 3,733,615 | A | * | 5/1973 | Jaffee | 2/232 |
| 3,737,916 | A | * | 6/1973 | Grenier | 2/70 |
| 3,742,518 | A | * | 7/1973 | Garcia | 2/79 |
| 3,889,297 | A | | 6/1975 | Jarboe et al. | |
| 4,017,910 | A | * | 4/1977 | Bente | 2/232 |
| 4,114,200 | A | * | 9/1978 | Smith et al. | 2/51 |
| 4,242,769 | A | * | 1/1981 | Rayfield et al. | 441/91 |
| 4,507,806 | A | * | 4/1985 | Coombs | 2/85 |
| 4,535,477 | A | * | 8/1985 | Musto et al. | 2/2.17 |
| 4,543,670 | A | * | 10/1985 | Ehring | 2/85 |
| 4,631,753 | A | * | 12/1986 | Ehring | 2/85 |
| 4,733,412 | A | * | 3/1988 | Campbell | 2/161.1 |
| 4,773,100 | A | * | 9/1988 | Kuo | 2/46 |
| 4,774,725 | A | * | 10/1988 | Page | 2/81 |
| 4,782,534 | A | * | 11/1988 | Grilliot et al. | 2/81 |
| 4,864,742 | A | * | 9/1989 | Grilliot et al. | 36/109 |
| 4,868,927 | A | * | 9/1989 | Bourdeau et al. | 2/161.1 |
| 4,922,552 | A | * | 5/1990 | Grilliot et al. | 2/93 |
| 4,924,529 | A | * | 5/1990 | Grilliot et al. | 2/123 |
| 4,941,213 | A | * | 7/1990 | Grilliot et al. | 2/312 |
| 4,993,077 | A | * | 2/1991 | Robison | 2/82 |
| 4,999,850 | A | * | 3/1991 | Grilliot et al. | 2/126 |
| 5,001,785 | A | * | 3/1991 | Heiman et al. | 2/123 |
| 5,005,216 | A | * | 4/1991 | Blackburn et al. | 2/79 |
| 5,038,410 | A | * | 8/1991 | Grilliot et al. | 2/81 |
| 5,073,988 | A | * | 12/1991 | Lewis et al. | 2/162 |
| 5,090,057 | A | * | 2/1992 | Aldridge | 2/82 |
| 5,125,114 | A | * | 6/1992 | Grilliot et al. | 2/124 |
| 5,136,724 | A | * | 8/1992 | Grilliot et al. | 2/81 |
| 5,138,717 | A | * | 8/1992 | Tolton | 2/123 |
| 5,208,919 | A | * | 5/1993 | Fields | 2/123 |
| 5,247,708 | A | * | 9/1993 | Freese, Jr. | 2/79 |
| 5,388,270 | A | * | 2/1995 | Hewitt | 2/93 |
| 5,542,124 | A | * | 8/1996 | Grilliot et al. | 2/81 |
| 5,555,561 | A | | 9/1996 | Plachta et al. | |
| 5,625,899 | A | * | 5/1997 | Snedeker | 2/81 |
| 5,680,653 | A | * | 10/1997 | Mathis et al. | 2/123 |
| 5,794,265 | A | * | 8/1998 | Reich | 2/125 |
| 5,794,268 | A | * | 8/1998 | Pessey | 2/227 |
| 5,884,332 | A | * | 3/1999 | Snedeker | 2/97 |
| 5,890,226 | A | * | 4/1999 | Snedeker et al. | 2/97 |
| 6,029,277 | A | * | 2/2000 | Picchione, II | 2/162 |
| 6,035,441 | A | * | 3/2000 | Mellon et al. | 2/125 |
| 6,079,051 | A | | 6/2000 | Whinston et al. | |
| 6,115,850 | A | * | 9/2000 | Grilliot et al. | 2/457 |
| 6,128,785 | A | * | 10/2000 | Sommeregger | 2/162 |
| 6,134,717 | A | * | 10/2000 | Grilliot et al. | 2/227 |
| 6,286,144 | B1 | * | 9/2001 | Henderson et al. | 2/69 |
| 6,336,223 | B1 | * | 1/2002 | Snedeker | 2/97 |
| 6,339,843 | B1 | * | 1/2002 | Grilliot et al. | 2/97 |
| 6,389,600 | B1 | * | 5/2002 | Di Maio | 2/121 |
| 6,665,878 | B1 | * | 12/2003 | Way | 2/84 |
| 6,665,880 | B2 | * | 12/2003 | Poppe | 2/114 |
| 6,684,408 | B2 | * | 2/2004 | Rindle et al. | 2/108 |
| 6,687,913 | B2 | * | 2/2004 | Aldridge | 2/81 |
| 6,748,609 | B1 | * | 6/2004 | Garigan | 2/457 |
| D507,392 | S | * | 7/2005 | Sieber | D2/742 |
| 6,983,490 | B1 | * | 1/2006 | Lewis et al. | 2/97 |
| 7,051,374 | B1 | * | 5/2006 | Grilliot et al. | 2/69 |
| 7,191,472 | B1 | * | 3/2007 | Kishino | 2/160 |
| 7,225,470 | B1 | * | 6/2007 | Bradford | 2/2.11 |
| 7,404,214 | B2 | * | 7/2008 | Woolcott et al. | 2/85 |
| 7,461,468 | B2 | * | 12/2008 | Grilliot et al. | 36/10 |
| 2003/0188368 | A1 | * | 10/2003 | Stinton | 2/2.16 |
| 2004/0006815 | A1 | * | 1/2004 | Carroll et al. | 2/457 |
| 2005/0022285 | A1 | * | 2/2005 | Berns et al. | 2/69 |
| 2005/0044605 | A1 | * | 3/2005 | Hofmann | 2/69 |
| 2005/0166300 | A1 | * | 8/2005 | Tanaka | 2/108 |
| 2005/0193472 | A1 | * | 9/2005 | Courtney et al. | 2/202 |

* cited by examiner 20
24

24
40
40
10
12
12

30
30

20
10c
10b
10a
62
32b
22
60
22c
10

72
24
70
26
32c
20a
20b
20c
40

52
10c
10b
10a
14
30
32a
50
12c 10c
10a
10b
60
22
10

10a
10b
10c
70
26
40

10b
10a
10c
14
50

PROTECTIVE GARMENTS HAVING ELASTOMERIC GASKETS ALONG MARGINS TO INHIBIT INGRESS OF POTENTIALLY HARMFUL MATERIALS

TECHNICAL FIELD OF THE INVENTION

This invention pertains to protective garments, such as protective coats, protective trousers, protective overalls, and protective coveralls, for firefighters and for emergency rescue workers. This invention contemplates that elastomeric gaskets extending along inside surfaces of margins of such garments inhibit ingress of potentially harmful materials.

BACKGROUND OF THE INVENTION

Commonly, firefighters or emergency rescue workers wear protective ensembles, in which the distal margins of the legs of protective trousers may fit loosely around protective boots, in which the distal margins of the arms of protective coats may fit loosely around protective gloves, and in which lower margins of protective coats may fit loosely around protective trousers. Such loosely fitting margins do not effectively inhibit ingress of potentially harmful materials, whether gaseous, liquid, or particulate.

SUMMARY OF THE INVENTION

Broadly, this invention provides, for a firefighter or for an emergency rescue worker, a protective garment having a margin, which is lined with an elastomeric gasket extending along an inside surface of the margin. The protective garment is exemplified by a protective coat, protective trousers, protective overalls, or protective coveralls. The elastomeric gasket, when stretched snugly, inhibits ingress of potentially harmful materials, whether gaseous, liquid, or particulate.

In one contemplated embodiment, the protective garment is exemplified by protective trousers, protective overalls, or protective coveralls and has two legs, each of which has a distal margin, which is lined with an elastomeric gasket extending along an inside surface of the distal margin. Preferably, the elastomeric gasket is adapted to be snugly stretched around a protective boot.

In another contemplated embodiment, the protective garment is exemplified by a protective coat and has a lower margin, which is lined with an elastomeric gasket extending along an inside surface of the lower margin. Preferably, the elastomeric gasket is adapted to be snugly stretched around protective trousers.

In another contemplated embodiment, the protective garment is exemplified by a protective coat and has two arms, each of which has a distal margin, which is lined with an elastomeric gasket extending along an inside surface of the distal margin. Preferably, the elastomeric gasket is adapted to be snugly stretched around a protective glove.

In another contemplated embodiment, the protective garment is exemplified by a protective coat and has a lower margin, which is lined with an elastomeric gasket extending along an inside surface of the lower margin, and has two arms, each of which has a distal margin, which is lined with an elastomeric gasket extending along an inside surface of the distal margin. Preferably, the elastomeric gasket extending along the inside surface of the lower margin is adapted to be snugly stretched around protective trousers and, moreover, the elastomeric gasket extending along the inside surface of the distal margin of each of the arms is adapted to be snugly stretched around a protective glove.

In another contemplated embodiment, an ensemble comprises protective trousers and a protective coat, the protective trousers having two legs, each of which has a distal margin, which is lined with an elastomeric gasket extending along an inside surface of the distal margin of the leg and being adapted to be snugly stretched around a protective boot. Further, the protective coat has a lower margin, which is lined with an elastomeric gasket extending along an inside surface of the lower margin and being adapted to be snugly stretched around the pair of protective trousers. Further, the protective coat has two arms, each of which has a distal margin, which is lined with an elastomeric gasket extending along an inside surface of the distal margin of the arm and being adapted to be snugly stretched around a protective glove.

In another contemplated embodiment, an ensemble comprises protective trousers, protective boots, a protective coat, and protective gloves, the protective trousers having two legs, each of which has a distal margin, which is lined with an elastomeric gasket extending along an inside surface of the distal margin of the leg and being adapted to be snugly stretched around one of the protective boots. Further, the protective coat has a lower margin, which is lined with an elastomeric gasket extending along an inside surface of the lower margin and being adapted to be snugly stretched around the protective trousers. Further, the protective coat has two arms, each of which has a distal margin, which is lined with an elastomeric gasket extending along an inside surface of the distal margin of the arm and being adapted to be snugly stretched around one of the protective gloves.

Preferably, if the or each protective trousers, protective coat, or other protective garment has an outer shell and a liner, which provides a moisture barrier or a moisture and chemical barrier and which may be an intermediate liner if the protective garment has an inner liner providing a thermal barrier, the or each elastomeric gasket extends from one such liner providing a moisture barrier or a moisture and chemical barrier. Preferably, moreover, the or each elastomeric gasket not only extends from but also is unitary with one such liner providing a moisture barrier or a moisture and chemical barrier.

DETAILED DESCRIPTION OF THE ILLUSTRATED EMBODIMENTS

Figures 1, 2, 3, 4, 5, 6, 7:
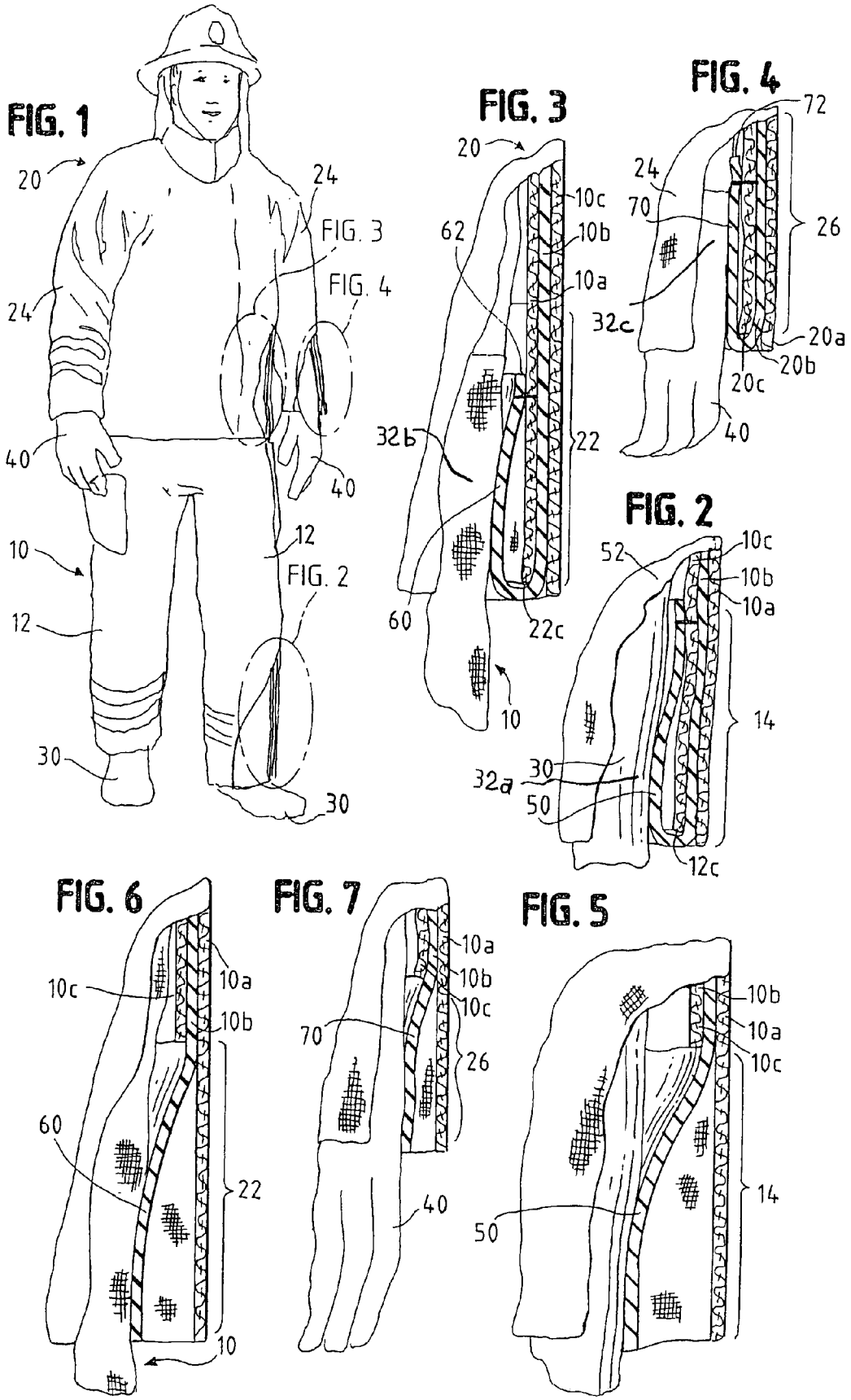
FIG. 1 is a pictorial, front view of a firefighter wearing a protective ensemble embodying this invention. The protective ensemble comprises protective trousers, protective boots, a protective coat, and protective gloves.
FIGS. 2, 3, and 4 are enlarged, fragmentary details, as taken in regions indicated in FIG. 1, to illustrate certain possible arrangements of elastomeric gaskets contemplated by this invention.
FIGS. 5, 6, and 7 are similar details illustrating other possible arrangements of elastomeric gaskets contemplated by this invention.

As illustrated, a protective ensemble worn by a firefighter comprises a pair of protective trousers 10 having two legs 12, each leg 12 having a distal margin 14, a protective coat 20 having a lower margin 22 and having two arms 24, each arm 24 having a distal margin 26, a pair of protective boots 30, and a pair of protective gloves 40. The pair of protective trousers 10 has an outer shell 10*a*, an intermediate liner 10*b*, such as a neoprene liner, which provides a moisture barrier, preferably a moisture and chemical barrier extending over a second area that is equal to a substantial portion of the first area to substantially block passage of moisture or chemicals through the first area to substantially block passage of moisture or chemicals through the first area of the outer shell 10*a* into contact with a worker wearing the trousers 10, and an inner liner 10*c*, which provides a thermal barrier. The protective coat 20 has an outer shell 20*a*, an intermediate liner 20*b*, such as a neoprene liner, which provides a moisture barrier, preferably a moisture and chemical barrier, and an inner liner 20*c*, which provides a thermal barrier, with corresponding components in relative proportions and functioning as those in the trousers 10. Except as illustrated and described herein, the pair of protective trousers 10, the protective coat 20, the protective boots 30, and the protective gloves 40 are outside the scope of this invention and may conform to protective trousers, protective coats, protective boots, and protective gloves used heretofore in protective ensembles for firefighters.

In one contemplated embodiment, as illustrated in FIGS. 1 and 2, the distal margin 14 of each leg 12 of the pair of protective trousers 10 is lined with an elastomeric gasket 50, which extends from and is unitary with the intermediate liner 10*b* such that there is no multi-layer structure or stitched seam connecting the gasket 50 or the liner 10*b*, which is folded over a distal edge 12*c* of the inner liner 10*c*, into said leg 12, and which is tacked, via stitching, at its distal edge 52 to the inner liner 10*c*, within said leg 12. In an alternative embodiment, which is not illustrated, the elastomeric gasket 50 is separate from but is affixed suitably, e.g., adhesively, via stitching, or adhesively and via stitching, to the intermediate liner 10*b*, within said leg 12. The elastomeric gasket 50 is sized, shaped, and adapted to be snugly stretched around an upper portion 32*a* of one of the protective boots 30, when the protective ensemble is donned. The elastomeric gasket 50 provides a moisture barrier, preferably a moisture and chemical barrier, whereby to inhibit ingress of potentially harmful materials, whether gaseous, liquid, or particulate.

In the aforementioned embodiment, as illustrated in FIGS. 1 and 3, the lower margin 22 of the protective coat 20 is lined with an elastomeric gasket 60, such as a neoprene gasket, which extends over a third area from and is unitary with the intermediate liner 20*b*, which is folded over a distal free edge 22*c* of the inner liner 20*c*, into the protective coat 20, and which is tacked, via stitching, at its distal edge 62 to the inner liner 12*c*. In an alternative embodiment, which is not illustrated, the elastomeric gasket 60 is separate from but is affixed suitably, e.g., adhesively, via stitching, or adhesively and via stitching, to the intermediate liner 20*b*, within the lower margin 22 of the protective coat 20. The elastomeric gasket 60 is sized, shaped, and adapted to be exposed at the inside of the margin to be snugly stretched around an upper portion 32*b* of the pair of protective trousers 10, when the protective ensemble is donned. The elastomeric gasket 60 provides a moisture barrier, preferably a moisture and chemical barrier, whereby to inhibit ingress of potentially harmful materials, whether gaseous, liquid, or particulate.

In the aforementioned embodiment, as illustrated in FIGS. 1 and 4, the distal margin 26 of each arm 24 of the protective coat 20 is lined with an elastomeric gasket 70, such as a neoprene gasket, which extends from and is unitary with the intermediate liner 20*b* such that there is no multi-layer structure or stitched seam connecting the gasket 50 or the liner 10*b*, which is folded over a distal edge 24*c* of the inner liner 20*c*, into said arm 24, and which is tacked, via stitching, at its distal edge 72 to the inner liner 12*c*, within said arm 24. In an alternative embodiment, which is not illustrated, the elastomeric gasket 70 is separate from but is affixed suitably, e.g., adhesively, via stitching, or adhesively and via stitching, to the intermediate liner 20*b*, within said arm 24. The elastomeric gasket 70 is sized, shaped, and adapted to be snugly stretched around an upper portion 32*c* of the pair of the gloves 40, when the protective ensemble is donned. The elastomeric gasket 70 provides a moisture barrier, preferably a moisture and chemical barrier, whereby to inhibit ingress of potentially harmful materials, whether gaseous, liquid, or particulate.

In an alternative embodiment, as illustrated in FIGS. 5, 6, and 7, the inner liner 10*c* does not extend into the distal margin 14 of each leg 12 of the pair of protective trousers 10, the elastomeric gasket 50 lining the distal margin 14 thereof is provided by a unitary, distal portion of the intermediate liner 10*b*, and the elastomeric gasket 50 is not folded or tacked, as described above. Moreover, the inner liner 10*c* does not extend into the lower margin 22 of the protective coat 20, the elastomeric gasket 60 lining the lower margin 22 thereof is provided by a unitary, distal portion of the intermediate liner 10*b*, and the elastomeric gasket 60 is not folded or tacked, as described above. Furthermore, the inner liner 10*c* does not extend into the distal margin 26 of each arm 24 of the protective coat 20, the elastomeric gasket 70 lining the distal margin 26 thereof is provided by a unitary, distal portion of the intermediate liner 10*b*, and the elastomeric gasket 70 is not folded or tacked, as described above. An outside portion of the elastomeric gasket 70 is directly exposed to an inside portion of the outer shell 10*a*. Another alternative embodiment, which is not illustrated, is similar to the alternative embodiment illustrated in FIGS. 5, 6, and 7, except that each of the elastomeric gaskets 50, 60, and 70 is separate from but is affixed suitably, e.g., adhesively, via stitching, or adhesively and via stitching, to the intermediate liner 10*b*.

In all embodiments, the inner and intermediate liners extend over a majority of the area of the outer shell.

In the alternative embodiment illustrated in FIGS. 5, 6, and 7, and in the alternative embodiment described in the final sentence of the preceding paragraph, each of the elastomeric gaskets 50, 60, and 70 provides a moisture barrier, preferably a moisture and chemical barrier, whereby to inhibit ingress of potentially harmful materials, whether gaseous, liquid, or particulate.

The invention claimed is:

1. For a firefighter or for an emergency rescue worker, a protective garment having a margin, for extension around a part of a worker wearing the protective garment, wherein the protective garment has an outer shell extending over a first area and a liner extending over a second area, the liner providing a moisture barrier or a moisture and chemical barrier inside the outer shell over a substantial portion of the first area to substantially block passage of moisture or chemicals through the first area of the outer shell into contact with a worker wearing the protective garment, and a single continuous layer of elastomeric material forms both the liner and an elastomeric gasket, the elastomeric gasket extending from and unitary with the liner such that there is no multi-layer structure or stitched seam connecting the gasket and the liner, the elastomeric gasket exposed at and extending over a third area on an inside surface of the margin and sized to be snugly stretched around a part around which the margin extends to form a seal, wherein the second area is substantially greater than the third area.

2. The protective garment of claim 1, wherein a portion of the liner resides between the elastomeric gasket and the outer shell.

3. The protective garment of claim 2, wherein the liner defines an intermediate liner and the protective garment further has an inner liner having a fourth area, the elastomeric material being folded over a portion of the inner liner so that the elastomeric gasket overlays the portion of the inner liner and the inner liner is located between the intermediate liner and elastomeric gasket.

4. The protective garment of claim 3, wherein the elastomeric gasket is adapted to be snugly stretched continuously around a protective boot.

5. The protective garment of claim 3, wherein the elastomeric gasket is adapted to be snugly stretched around protective trousers on a worker.

6. The protective garment of claim 3, wherein the protective garment has two legs and the margin is defined at one of the legs.

7. The protective garment of claim 3, wherein the protective garment is a protective coat with a lower region at which the margin is defined.

8. The protective garment of claim 7, wherein the elastomeric gasket is adapted to be snugly stretched around a protective glove on a worker.

9. The protective garment of claim 3, wherein the protective garment has two arms and the margin is defined at one of the arms.

10. The protective garment of claim 3, wherein the inner liner extends over a majority of the first area and defines a thermal barrier.

11. The protective garment of claim 3, wherein an intermediate liner extends over a majority of the first area.

12. The protective garment of claim 3, wherein the inner liner has a free edge and the intermediate layer wraps around the free edge of the inner liner.

13. The protective garment of claim 3, wherein the inner liner, and intermediate liner each extends over a majority of the first area.

14. The protective garment of claim 1, wherein the liner defines an intermediate liner and the protective garment further has an inner liner and a portion of the intermediate liner resides between the inner liner and outer shell.

15. The protective garment of claim 14, wherein an outside portion of the elastomeric gasket is directly exposed to an inside portion of the outer shell.

* * * * *